United States Patent [19]

Viessmann

[11] 4,192,259

[45] Mar. 11, 1980

[54] STEEL HEATING BOILER FOR LIQUID OR GASEOUS FUELS

[76] Inventor: Hans Viessmann, Im Hain, 3559 Battenberg, Eder, Fed. Rep. of Germany

[21] Appl. No.: 905,505

[22] Filed: May 12, 1978

[30] Foreign Application Priority Data

May 14, 1978 [DE] Fed. Rep. of Germany ..... 2721895

[51] Int. Cl.[2] ..... F22B 31/00

[52] U.S. Cl. ..... 122/136 R; 122/136 C; 122/149

[58] Field of Search ..... 122/136 R, 136 C, 149

[56] References Cited

U.S. PATENT DOCUMENTS

| | | | |
|---|---|---|---|
| 3,734,066 | 5/1973 | Scheyen | 122/136 |
| 4,109,614 | 8/1978 | Viessmann | 122/149 |

*Primary Examiner*—Henry C. Yuen

*Attorney, Agent, or Firm*—Posnack, Roberts, Cohen & Spiecens

[57] ABSTRACT

A steel heating boiler for liquid or gaseous fuels, with a water-bearing housing, between the front and rear walls of which is arranged in a liquid-tight manner a cylindrical installation unit consisting of combustion chamber and fuel-gas flues. The steel heating boiler which is intended for the operation of hot-water heating systems is distinguished by the fact that the installation unit, whose combustion chamber and fuel-gas flues are provided with a corrosion-resistant lining known per se, has on the inside end closure members included in the lining, whose outside diameter is larger than the outside diameter of the installation unit, the outer peripheral edges of the end closure members being connected to the opening edges of the front and rear walls in a liquid-tight way and at least the inside diameter of the burner-side end closure member being made smaller than the inside diameter of the installation unit.

7 Claims, 5 Drawing Figures

STEEL HEATING BOILER FOR LIQUID OR GASEOUS FUELS

FIELD OF INVENTION

The invention relates to steel heating boilers for liquid or gaseous fuels, and, more particularly, to boilers of the type provided with a water-bearing housing, between the front and rear walls of which is arranged in a liquid-tight way a cylindrical installation unit consisting of combustion chamber and fuel-gas flues.

BACKGROUND

Steel heating boilers of the above-mentioned type are generally known. To enable heating boilers to be operated with smoothly variable temperatures, it has also become known to provide the installation unit on the burner and fuel-gas sides with corrosion-resistant linings consisting, for example, of enamel suitable for this purpose.

Apart from the fact that heating boilers, where the spaces carrying the burner flame and fuel gases form an installation unit, can be manufactured very economically under certain preconditions, such installation units designed very simply in terms of spatial relationships are, of course, also very advantageous from the point of view of the application or coating of a corrosion-preventing or enamel lining, as defined in Volume 4, Sanitary and Heating Engineering, 1965, page 316, as corrosion protection in boiler construction.

However, in such constructions, the closures at the front and/or rear at the entrances to the tubular installation unit are of critical importance, since the condensate occurring unavoidably can, on the one hand, attack the closure seals and/or leak out and then damage the outer faces of the boiler. On the other hand, there is the difficulty of welding into the housing the unit which must receive its corrosion-resistant lining before installation in the water-bearing housing, without damaging the lining during welding.

SUMMARY OF INVENTION

An object of the invention is to take into account these problems, that is, to provide a steel heating boiler of the above-mentioned type, so that the condensate which occurs can attack by corrosive action neither the seals nor the outer faces and so that the lined unit carrying the flame and gas can be welded into the water-bearing boiler housing without endangering the corrosion-resistant lining.

This problem is solved according to the invention by the provision of a special installation unit having combustion chamber and fuel-gas flues provided with a corrosion-resistant lining known per se. The unit further has on the inside end closure members included in the lining, whose outside diameter is larger than the outside diameter of the installation unit, the outer peripheral edges of the end closure members being connected in a liquid-tight way to the opening edges of the front and rear walls. The arrangement is further characterized in that at least the inside diameter of the burner-side end closure member is smaller than the inside diameter of the installation unit.

This design enables the installation unit, which can be made as a separate component before installation in the boiler housing, to receive a corrosion-resistant lining on the firing side before installation and to be welded afterwards without difficulty into the openings of the front and rear walls. Thereby, according to a characterizing feature of the invention, there is obtained on the burner side a damming step, as it were, for condensate which occurs, yet which owing to the step formation cannot reach the seal of the end closure member on the burner side, but can evaporate in this region.

The criterion "at least the burner-side end closure member" includes an end closure member construction of the outlet side which corresponds to the burner side, but also a design of the outlet side which is such that the latter is made like a container bottom (provided, of course, with outlet openings) and is connected fast to the installation unit.

The heating boiler according to the invention and various advantageous features are described in detail hereinafter in exemplary embodiments by reference to the accompanying drawing.

DETAILED DESCRIPTION

Figure 1:
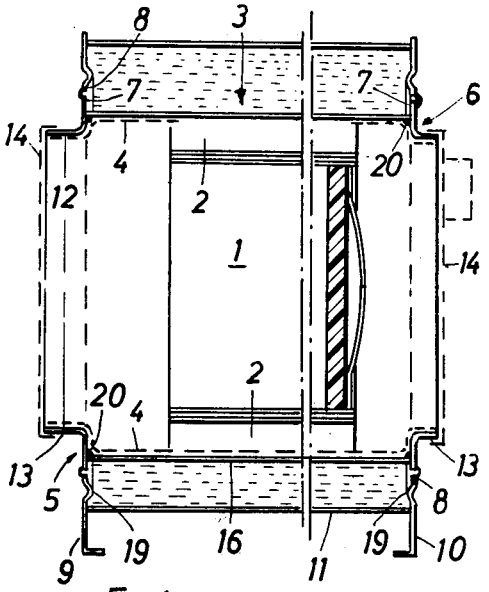
FIG. 1 is a longitudinal section through a steel heating boiler in accordance with one embodiment of the invention.
Figure 3:
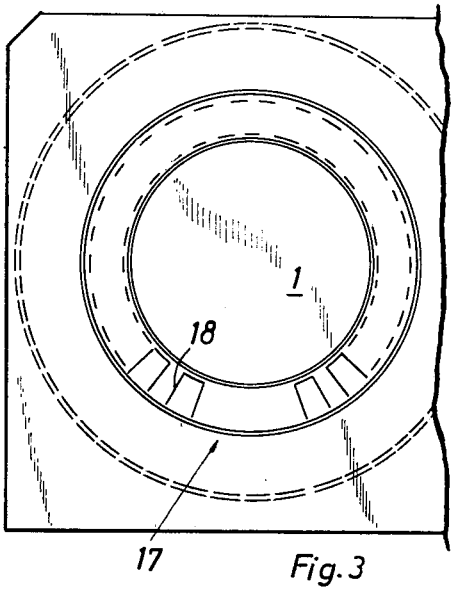
FIG. 3 is a cross section through the steel heating boiler according to FIG. 1.

In the drawing, 1 denotes a pot-like combustion chamber insertable into the free space between the fuel-gas flue insets 18, 2 designates the fuel-gas flues, 3 designates the installation unit, 4 denotes the corrosion-resistant lining, 5,6 denote the burner-side and outlet-side end closure members, 7 designates their peripheral edges, 8 denotes the opening edges in the front and rear walls 9,10 of the boiler housing 11, and 12 designates the inside diameter of the burner-side end closure member 5.

In the embodiment according to FIG. 1 the end closure members 5,6 are made correspondingly annular and are provided with rims 13 for the sealed attachment of the burner-side and waste-gas-side covers 14 (indicated by broken lines).

As can be readily perceived, damming steps are formed in front of the covers, so that condensate which occurs can neither reach the seals nor escape through the cover gaps, allowance being made for the fact that although the covers can still be gas-tight, they may no longer suffice for liquid-tight sealing in course of time.

For making the rings or end closure members 5,6, circular cut-outs are used. These are stamped out of the front and rear walls 9,10 and correspondingly shaped, so that only a minimal amount of steel sheet is wasted.

Continuous corrugations 19 are advantageously embossed into the front and rear walls 9,10. This necessarily involves a certain enlargement of the diameters of the circular opening edges 8, so that the complete installation unit 3 can easily be introduced and welded into the boiler housing 11.

To facilitate and accelerate the evaporation of condensate which forms in the lower region of the boiler, the bottom region 17 is kept free of fuel-gas flue fitting units 18, so that a larger quantity of hot gas can flow over it and evaporate the condensate.

To prevent gaps from forming as far as possible—gaps can hardly be bridged permanently with enamelling or other protective linings—the end closure members 5,6 are advantageously welded to the peripheral shell 16 by inner welded joints 20 which then disappear completely under the lining 4.

Figure 2:
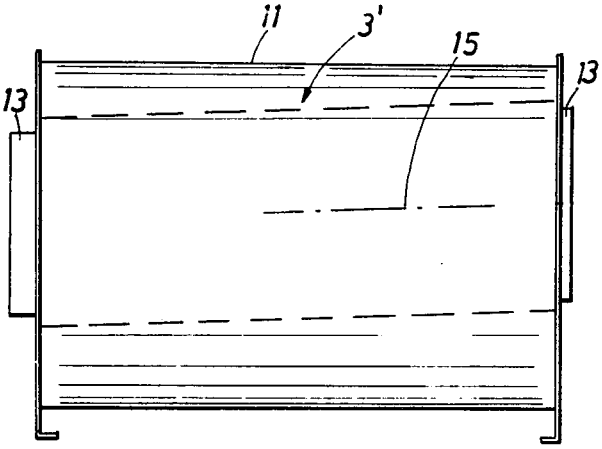
FIG. 2 is a longitudinal section through a steel heating boiler in another embodiment.
Figure 5:
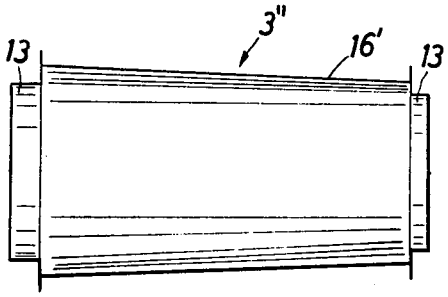
FIG. 5 is a longitudinal section through the steel heating boiler in a further embodiment.

As can be seen at once from FIGS. 2 and 5, it is possible, while retaining the same principle of construction, to arrange the installation unit 3' with its axis 15 ascending towards the outlet side or also to make the installation unit 3'' in the form of a weak truncated cone, so that in both cases condensate which occurs runs to the hot burner region where it quickly evaporates.

Figure 4:
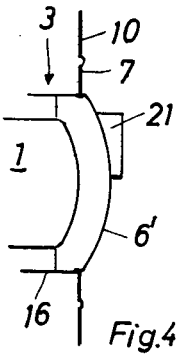
FIG. 4 is a partial section of the steel heating boiler in the outlet region.

The same principle of construction can be implemented if, according to FIG. 4, the outlet side is provided not, as described, with an annular end plate, but with an end plate 6' like a container bottom, which is provided with outlet openings 21 and is welded fast to the jacket 16 of the installation unit.

I claim:

1. A steel heating boiler for liquid or gaseous fuels, said boiler comprising a water-bearing housing including front and rear walls having openings surrounded by opening edges, a cylindrical installation unit including combustion chamber and fuel-gas flues being arranged in a liquid-tight way between said front and rear walls, the installation unit including a corrosion-resistant lining for said combustion chamber and fuel-gas flues, said unit further including end closure members covered at least in part by the lining, the end closure members having an outside diameter larger than the outside diameter of the installation unit and having outer peripheral edges connected in liquid-tight relation to the opening edges of the front and rear walls, the inside diameter of at least one said closure member being smaller than the inside diameter of the installation unit.

2. A steel heating boiler according to claim 1, comprising covers and wherein the end closure members include outwardly directed, annular rims as mounting flanges on which the covers are mounted.

3. A steel heating boiler according to claim 1, wherein the cylindrical installation unit is arranged inside the housing with said unit having an axis which is inclined between the end closure members.

4. A steel heating boiler according to claim 1 wherein the installation unit is in the form of a truncated cone.

5. A steel heating boiler according to claim 1 wherein the installation unit includes a bottom region free of fuel-gas flues.

6. A steel heating boiler according to claim 1 wherein continuous corrugations enlarging the size of the openings in the front and rear walls are embossed into the front and rear walls concentrically to the openings.

7. A steel heating boiler according to claim 1 wherein the unit includes a peripheral shell and the end closure members are connected to the peripheral shell by inner weld joints.

* * * * *